United States Patent [19]

Mitter

[11] 4,254,643

[45] Mar. 10, 1981

[54] DOT PRINTER

[76] Inventor: Mathias Mitter, Falkenstrasse 57, 4815 Schloss Holte, Fed. Rep. of Germany

[21] Appl. No.: 964,783

[22] Filed: Nov. 28, 1978

[30] Foreign Application Priority Data

Nov. 30, 1977 [DE] Fed. Rep. of Germany ..... 2753295

[51] Int. Cl.³ ..... D06B 1/08

[52] U.S. Cl. ..... 68/200; 400/121

[58] Field of Search ..... 400/121, 124, 126; 68/200, 205 R

[56] References Cited

U.S. PATENT DOCUMENTS

| | | | |
|---|---|---|---|
| 3,108,673 | 10/1963 | Green | 400/121 |
| 3,426,880 | 2/1969 | Blodgett | 400/124 |
| 3,715,020 | 2/1973 | Nordin | 400/124 |
| 4,018,152 | 4/1977 | Heidrich | 101/292 X |
| 4,089,401 | 5/1978 | Scott | 400/125.1 |

*Primary Examiner*—Paul T. Sewell

*Attorney, Agent, or Firm*—Michael J. Striker

[57] ABSTRACT

A dot printer has reciprocable plungers and a constantly oscillating drive member. The plungers are held in a normal rest position and are selectively coupled to and uncoupled from the drive member, to share the oscillations thereof when the respective plungers are to print.

4 Claims, 8 Drawing Figures 40
4
44
142
41

42
40
140
151
4a
St
46
41a
51
45b
17
E
5
G
45
1a
+
B
47
45a
44a
1
−

44b
50
A
12
49
14
149
11
48
4b
1b
13
1b'
1b"
10
16
18
15
F
1'
2
3

50
51
151
5
1''
43'
B
+
-
52
44
4
43
141
1
150
250
350
16
10
14
1'
13
P
53
54
252
152
260
64
6
62
63
265
65
60
61
160
165

DOT PRINTER

BACKGROUND OF THE INVENTION

1. Field of the Invention

The present invention relates to printing apparatus.

More particularly, the invention relates to dot printers.

Still more specifically, the invention relates to arrangements for controlling the movements of plungers in dot printing apparatus.

2. The Prior Art

Dot printers are printing apparatuses in which reciprocable plungers or similar elements cause the application of a flowable medium to a substrate, i.e., a workpiece web, during their reciprocation. The medium, in the prior art and also hereinafter with respect to the invention, may be printing ink, adhesive, or any other flowable substance that can be applied to the substance; for convenience it will hereafter be called "printing ink".

Depending upon the spacing of adjacent plungers, or upon which ones of adjacent plungers are activated during a particular operating cycle and which ones are not activated at that time, the substrate may be printed with discrete (spaced-apart) dots (which may or may not form a pattern of e.g., lines), or the adjacent dots may merge so that the substrate is printed with e.g., a continuous coating of color (which may or may not be uni-colored).

The operation of the plungers in the prior art (i.e., the selection of which plungers are to operate and the timing of their operation) can be controlled by means of computers, punch-card controls, magnetic-tape controls and the like. The actual movement of the plungers is effected by electromagnets or pressure cylinders which cooperate with the free end of the respective plunger and which reciprocate the plunger in response to command signals issued by the computer or other control device.

While the prior-art proposals give highly satisfactory printing results, it has been found that their structural execution is rather expensive because, as explained above, each individual plunger or group of jointly moving plungers must be provided with a separate motion-imparting arrangement.

SUMMARY OF THE INVENTION

It is, accordingly, an object of the invention to provide further improvements over the prior art.

More particularly, it is an object of the invention to provide a dot printer with a plunger-control arrangement which is simpler and less expensive than those of the prior art.

Still more specifically, it is an object of the invention to provide an arrangement of the type under discussion wherein it is not necessary to furnish each of the plungers with its own separate motion-imparting device.

A concomitant object is to provide an arrangement in which individual plungers or groups of plungers are selectable for reciprocation as a function of a pattern to be applied to a substrate.

Another object is to provide such an arrangement wherein motion is imparted to the plungers by a movable element which preferably is in constant movement. It is advantageous if a single such movable element is provided for effecting the reciprocation of a plurality of the plungers.

Pursuant to these objects and to others which will become apparent hereafter, one aspect of the invention resides in an arrangement for controlling the movement of plungers in a dot printing apparatus. Briefly stated, the arrangement may comprise a plurality of adjacent printing plungers; means mounting the plungers for reciprocation in respective upright paths; means retaining each of the plungers in a neutral rest position; drive means performing an oscillating movement in direction lengthwise of the paths; and means for intermittently coupling selected ones of the plungers to, and for subsequently uncoupling them from the drive means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 1A, 1B:
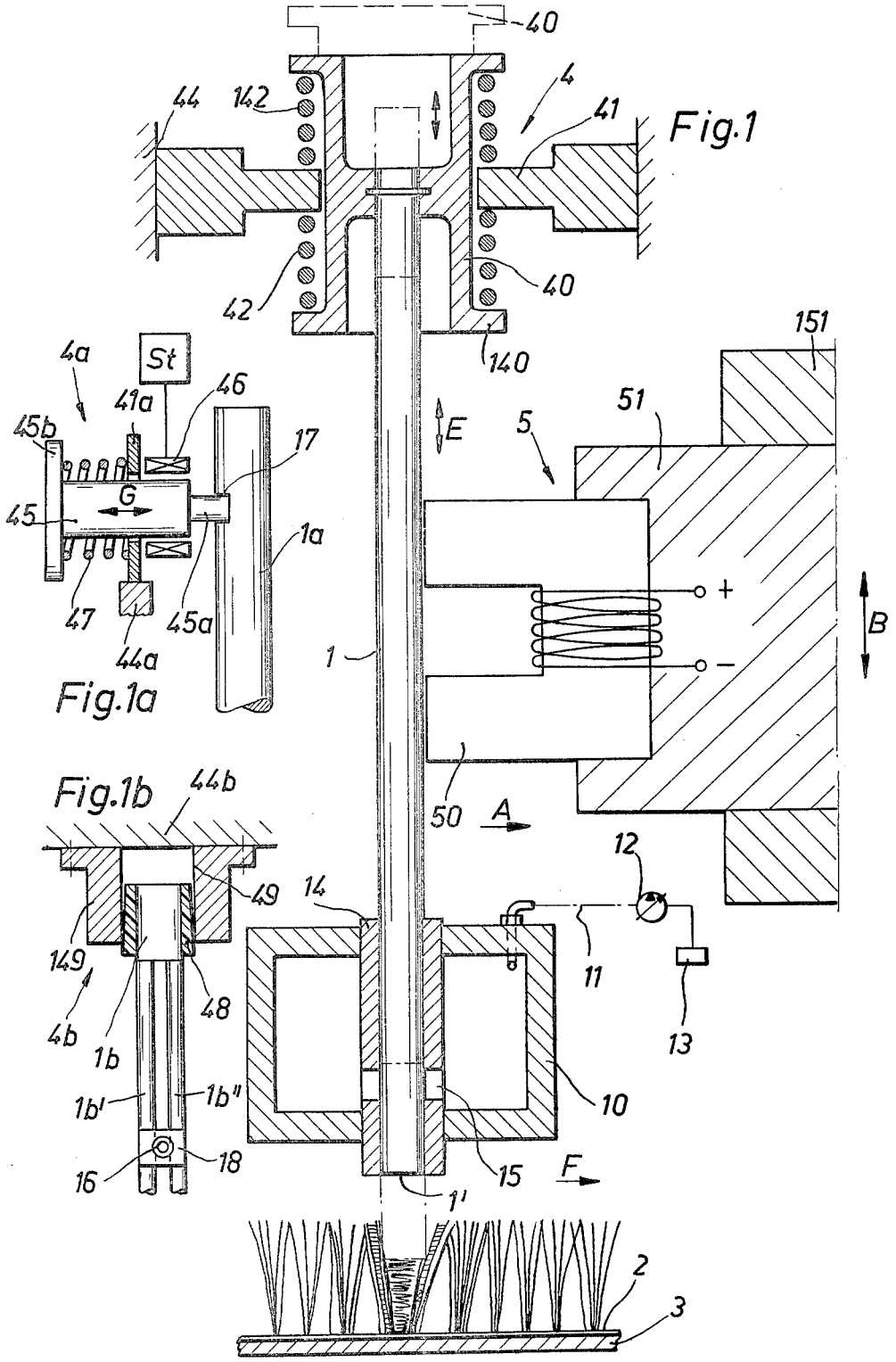
FIG. 1 is a fragmentary vertical section through an arrangement according to the invention.
FIG. 1*a* is a view analogous to FIG. 1, showing another embodiment on a smaller scale.
FIG. 1*b* is similar to FIG. 1*a* and shows a further embodiment.

A first embodiment of the invention is illustrated in FIG. 1. It will be understood that ordinarily a dot printer has a large number of individual dot-printing elements (for convenience called "plungers" herein) which are arranged adjacent one another and which may also be staggered relative to one another. However, since this is known per se, FIG. 1 illustrates only a single such plunger 1 for the sake of simplicity.

Each plunger 1 is mounted in a holding device 4 which permits it to be reciprocated (vertically or substantially vertically) as indicated by the arrow E. During such reciprocation each reciprocating plunger 1 (evidently, not all plungers need reciprocate at one time, since some can be selected to do so and others remain stationary) applies a dot or spot of printing ink or other equivalent substance to the substrate 2, i.e., the workpiece web which in FIG. 1 is a napped carpet. The substrate 2 may be supported on a conventional printing blanket 3 (known per se) and travel with the same either continuously or discontinuously in the direction of the arrow F. However, it is also possible to advance the printing blanket (and hence the substrate 2) only stepwise; in that case the device composed of the elements 1, and their associated components (still to be discussed)

will be moved relative to the stationary substrate 2 in the direction F and only when a predetermined length of the substrate has been printed will the substrate then be moved to place a fresh (not yet printed) substrate portion beneath the device.

Printing ink is supplied to the plungers 1 in any suitable manner. In the illustrated embodiment of FIG. 1 an ink manifold 10 is provided which is vertically penetrated by sleeves 14 (one for each plunger 1 but only one shown) which are provided with openings 15 to communicate with the interior of the manifold 10. The manifold 10 communicates via a line 11 with an ink reservoir 13. Interposed in the line 11 is a pump 12 (preferably of the known-per-se continuously variable type) which supplies ink to the manifold; a slight overpressure (over atmospheric pressure) may prevail in the manifold 10.

As each plunger 1 reciprocates its front or leading end 1' is retracted rearwards (upwards) of the opening 15, so that ink can enter the sleeve 14 from the manifold. It will be understood that the ink or other medium is generally of a sufficiently viscous composition so that the quantity of ink entering the sleeve 14 will not simply run out through the lower open end of the same, but will be retained due to surface tension and/or the capillary action of the sleeve 14. During the subsequent working stroke of the plunger 1 the front end 1' closes the openings 15 (thus assuring that during each operation a metered amount of ink is used) and the ink in the sleeve 14 is expelled from the same onto the substrate 2 (depending upon the length of the working stroke the ink may be made to enter into the nap and down to the base material of the substrate).

It should be noted that although a particular type of plunger arrangement is illustrated in the drawings, the invention is not limited to use with such arrangement. It is, rather, applicable to any type of arrangement for applying ink to a substrate, so long as the instrumentalities which apply the ink or permit its application, are axially reciprocable towards and away from the substrate.

The holding devices 4 (one shown) for the plungers 1 may be mounted in a common rail or beam 44. In the illustrated embodiment each device 4 has a sleeve 40 which is mounted on the upper free end of the plunger 1 and provided with radially outwardly extending flanges 140. A fixed annular member 41 (mounted in rail 44) surrounds the sleeve 40 with slight clearance and two equally strong springs 42 and 142 are each confined between one of the opposite surfaces of the member 41 and a respective one of the flanges 140. The springs thus hold the plunger 1 in a "floating" centered position in which the lower end 1' is located at least slightly forward (downward) of the openings 15 to prevent the entry of ink through the same.

From this centered or neutral position the plungers 1 are to be reciprocated, i.e., first retracted and then advanced. For this purpose each of the plungers 1 has associated with it a coupler 5 which oscillates in the direction indicated by the arrow B. It is important to note that these couplers 4 (one shown) are not powered drives as in the prior art, but that they only serve to couple a plurality of the plungers 1 to a common drive.

In FIG. 1 this coupler 5 is in form of a U-shaped electromagnet 50 which is mounted on or in a mounting member 51. The latter, in turn, is mounted on a support 151 which oscillates in the directions indicated by the arrow B. The electromagnet 50 can be switched on and off (instrumentalities for this are known per se) and, when energized, magnetically attracts the magnetizable plunger 1 and takes the same along, i.e., it couples the plunger to the support 151 for movement with the same until the magnet is de-energized again. It goes without saying that the elements 51 could be otherwise connected with a joint drive (in lieu of the support 151) and that they may be provided with suitable guide and/or control means for their movements.

Since the support 151 and hence the respective elements 51 oscillate constantly in the directions of arrow B, the determination which of the plungers 1 is to be reciprocated (i.e., to print) and for how long depends upon whether and how long its associated electromagnet 50 is energized. When the energization is effected, the plunger 1 reciprocates with the element 51 to which it is now magnetically coupled by the electromagnet 50, against the action of the springs 42, 142 (i.e., first compressing one while relaxing the other and then reversing this relationship). Whenever, during these movements, the front end 1' is withdrawn behind (above) the openings 15, ink enters sleeve 14 through the openings to be expelled through the lower open end of the sleeve 14 as the plunger 1 reverses its direction and now advances (moves forwardly).

A different embodiment of the device 4 is illustrated in FIG. 1*a* and there designated with reference numeral 4*a*.

In this embodiment, which in its other aspects may be the same as the one in FIG. 1, the rear end of the plunger 1*a* is formed with a recess or notch 17. Opposite the notch is a member 45 having a leading portion 45*a*; this member 45 is slidably received in an opening of an annular member 41*a* which in turn may be mounted on a stationary support 44*a*. A spring 47 is confined between and connected to the member 41*a* and a flange 45*b* on the member 45, respectively.

The portion 45*a* extends into the notch 17 of the plunger 1 and is held in this position against the urging of the spring 47. An electromagnet 46 surrounds the member 45 and is controlled (energized and de-energized) by a control device St (known per se). The device St may operate reciprocally with respect to the electromagnet 50, respectively to the device 5 should the same not use an electromagnet.

When the magnet 46 is de-energized by the device St the spring 47 retracts the member 45 (with its portion 45*a*) from the notch 17. At the same time the magnet 50 associated with the plunger 1 is also energized and magnetically couples the plunger 1 to the device 5 for reciprocation with the same in the direction of arrows E (corresponding to the direction of arrows B). When the magnet 46 is subsequently re-energized it reinserts the portion 45*a* into the notch 17 as soon as the two are in registry while compressing the spring again. At this time the magnet 50 is then, of course, switched off. Needless to say, the device 4*a* could be controlled in other ways, also.

FIG. 1*b* shows an embodiment wherein the holding device is designated with reference numeral 4*b*. In all respects other than the device 4*b* this embodiment may be identical with the one in FIG. 1.

In FIG. 1*b* the plunger 1*b* has two plunger members 1*b'* and 1*b''* which are connected by a plate 18 or analogous element. The upper ends of the members 1*b'* and 1*b''* are also connected, namely by a head portion which carries a frustoconical member 48 of soft, elastically compressible natural or synthetic rubber or synthetic plastic material. The stationary member 44*a* carries a socket 149 into a bore 49 of which the member 48 fits with friction. Thus, when not in use (i.e., for printing) the plunger 1*b* of this embodiment is held in its inoperative position by the friction between the members 48 and 149. Of course, the embodiment is susceptible to various modifications which will offer themselves readily to those skilled in the art.

Figures 2, 3, 3A, 4, 5:
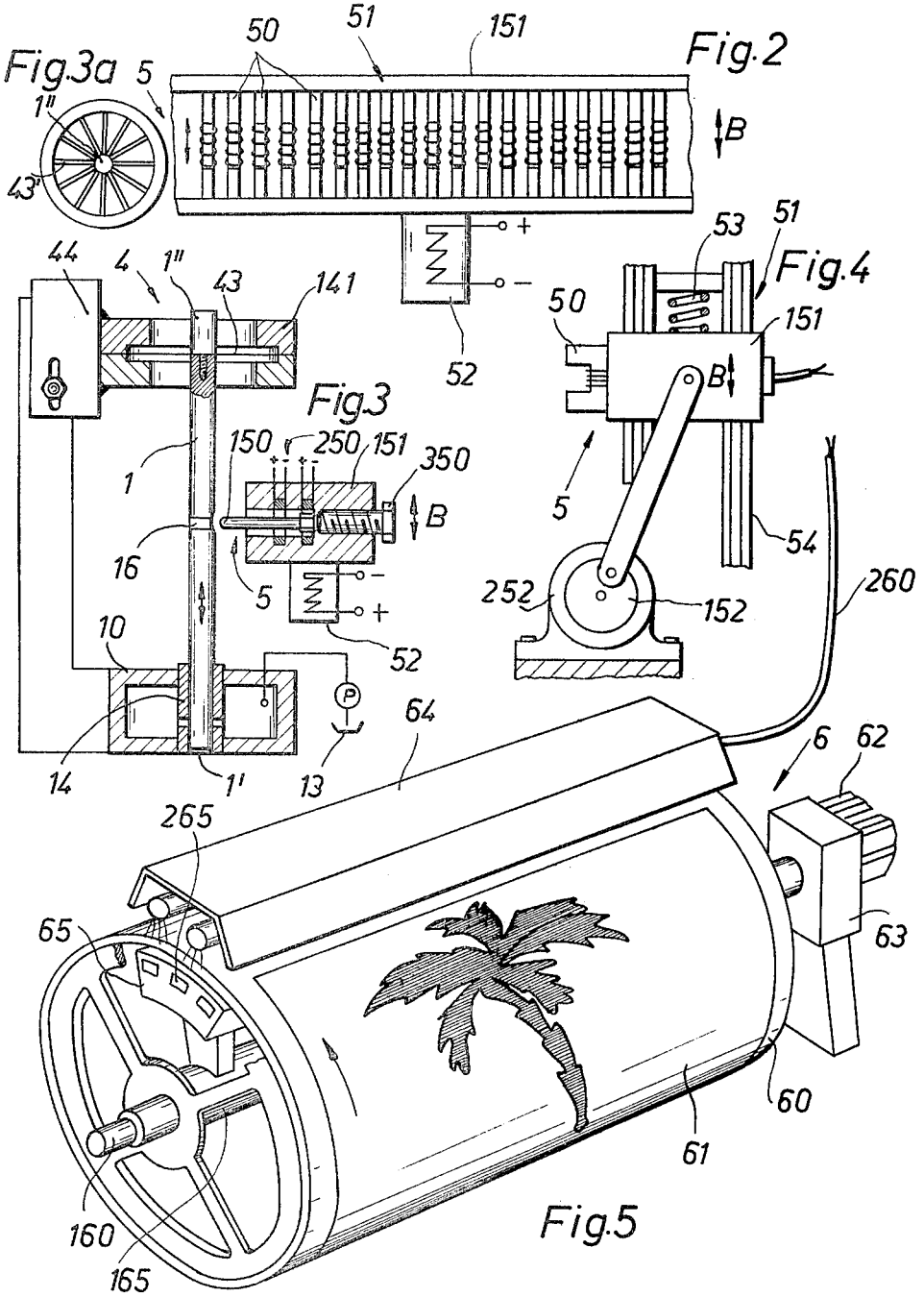
FIG. 2 is a view as seen in the direction of arrow A in FIG. 1, showing a detail.
FIG. 3 is a fragmentary vertical section through yet another embodiment.
FIG. 3*a* a view of elastomeric filaments.
FIG. 4 is a partly sectioned fragmentary side view, illustrating a common drive for use in embodiments of the invention.
FIG. 5 is a perspective view, showing details of an arrangement for controlling the operation of the plungers as a function of a pattern to be printed.

Details of the common drive for the plungers, or for the plungers of certain groups, are shown in FIG. 2. The oscillatory support 151 (for example a working beam) carries the members 51 which in turn carry the electromagnets 50 each of which is associated with a single plunger or else with a group of (two or more) plungers. Evidently, even if the couplers 5 are not in form of electromagnets they can nevertheless be mounted on an oscillatory support corresponding to the support 151.

Oscillation in the direction of arrow B is imparted to the support 151 by a high-frequency vibrator 52 which is connected to the support 151 to oscillate the same. As the support 151 oscillates, all the elements 51 on it oscillate with it. This oscillation is transmitted (or not transmitted) to the respective plungers 1 in dependence upon whether or not the electromagnet 50 (or equivalent means) is energized to couple the plungers to their members 51.

FIG. 3 shows the device 4 to be in form of two annular members 141 which are fixedly mounted on the member 44. An elastically yieldable diaphragm 43 (of metal or elastomeric material) spans the opening of the members 141 and has its outer edges clamped between them. The upper end portion of plunger 1c is coupled to the diaphragm 43 by e.g., a detachable head portion 1''. The diaphragm 43 thus acts in a manner analogous to the springs 42, 142 of FIG. 1 and can, of course, be replaced by other metallic or elastomeric spring elements, such as e.g., elastomeric strips or filaments.

The drive is again supplied by a member 151 which is oscillated by the high-frequency vibrator 52 in the directions of arrow B. The plunger 1*c* (or, if two or more are connected for joint movement, the plate 18 connecting them as in FIG. 1*b*) is provided with an opening or a bore 16 having preferably a convergent inlet opening. A retaining member 150 can enter into this bore and is, for this purpose, slidably guided in the member 151. A set screw 350 limits the extent to which the member can be retracted away from the plunger 1. Annular electromagnets 250 surround the member 150 and, depending upon which one of them is energized, advance the member 150 into the bore 16 or retract it from the same. When the member 150 is received in the bore 16, it couples the plunger 1*c* for reciprocation with the oscillating member 150. In all other respects this embodiment corresponds to the one in FIG. 1.

It is clear that the oscillations of member 151 (or of a different member in lieu thereof) need not be produced by the vibrator 52 mentioned before. Other possibilities will offer themselves. By way of one possible example, FIG. 4 shows the member 151 mounted in upright guides 54 (there may be four—two at each end—or more). Portions of the element 151 may extend into recesses of the guides 54 or such portions may externally embrace portions of the guides. The oscillation of member 151 in direction of the arrows B is effected by its connection to a crank drive 152. Any rapidly operating crank drive or eccentric drive may be used, and may be driven by e.g., a continuously variable gear motor 252. Upward movement of the member 151 is opposed by the biasing force of restoring springs 53.

Finally, FIG. 5 shows a pattern-sensing mechanism 6 by means of which the plungers can be controlled in dependence upon a sensed pattern to be printed.

The mechanism 6 has a transparent drum 60 of e.g., glass or synthetic plastic material. A pattern 61 is applied to the drum (e.g., a negative film or a positive film), having transparent as well as opague regions as shown. The drum 60 with the applied pattern 61 is rotated in the direction of the arrow by a drive 62 via e.g., a continuously variable gear drive 63. The drum 60 normally rotates in synchronism with the advancement of the printing blanket 3 (FIG. 1); however, by operation of the variable gear drive 63 it may also be made to rotate faster or slower than the blanket 3 advances.

Mounted adjacent one of the interior and exterior surfaces of the drum 60 is a light strip 64 having one or more (usually elongated) light sources as shown. Mounted adjacent the other of the interior and exterior drum surfaces, opposite the light strip 64, is a strip 65 carrying a plurality of selenium cells or other suitable light-sensitive elements 265. Strip 65 may be mounted on a sleeve 165 of the drum shaft 160; however, other ways of mounting are also conceivable and what is important is that the strip 65 must not interfere with the rotation of drum 60.

The selenium cells or other light-sensitive elements are directly electrically connected with the couplers 5 of the respective plungers (e.g., FIG. 1) via the lines 260. Therefore, if during the rotation of drum 60 an opaque portion of the pattern on member 61 passes between the light from strip 64 and certain of the light-sensitive elements of strip 65, these light-sensitive elements produce a signal which is transmitted via lines 260 to the associated couplers 5 (e.g., to the electromagnets 50 thereof) which are energized as a result of the signal. This couples the respective plungers 1 to the support 151 or analogous element so that they reciprocate with the same (and print on the substrate) until the opaque pattern area passes beyond the respective light-sensitive element and the signal ceases to be produced. Immediately upon the cessation of the signal the plungers 1 are uncoupled from the support 151 and return to rest position. Of course, depending upon the electrical connection of the light-sensitive elements, these elements could produce a signal while a transparent part of the pattern passes them and could cease to produce the signal when they are passed by an opaque pattern part. This obvious reversal will offer itself to those skilled in the art.

The present invention assures that only the couplers 5 need be energized and de-energized and that only a single drive (e.g., member 151) need be provided for large numbers of the plungers. This single drive can operate continuously, since the plungers 1 need merely be coupled to it and uncoupled from it. The plungers themselves require only one holding device each, since they can be readily fixed in their rest positions by friction (FIG. 1*b*), by springs or elastomeric means (FIGS. 1, 4) or, if necessary or desired, by selectively operable holding elements (FIGS. 1*a*, 3).

The couplers 5 need to receive only two simple command signals, namely "on" and "off;" the actual motion-imparting drive (members 51, 151) operates continuously and requires no control signals.

It is, of course, possible to drive all plungers from a single drive (e.g., 151), to the extent that this is desirable or is technically feasible in view of the number of plungers involved. Alternatively, the plungers may be divided in groups of desired numerical size and each group be provided with a separate drive. Even this is very much simpler and less costly than to provide each plunger with its own drive (e.g., fluid-operated cylinder).

The arrangement according to the invention makes it readily possible to operate selected individual plungers or groups of plungers, by coupling them to the drive. When resort is had to the arrangement shown in FIG. 5, then the plungers (via their couplers) are controlled directly by the pattern to be printed (i.e., the pattern 61 on drum 60), thus obviating the need for a more complicated control by computer, punch card system or tape system. A switch-over from printing of one pattern to printing of an entirely different pattern can be effected in the simplest possible manner, merely by replacing one pattern 61 on the drum 60 with a different pattern. It is not even necessary to shut down the equipment, since the operating functions remain unaffected by the pattern change and the equipment will simply begin to print a new pattern as soon as the same is in place on the drum and the drum turns.

The disclosed invention is susceptible of a variety of modifications which are intended to be encompassed in the protection sought. As explained, although the position in which the respective device 4 holds its associated plunger 1 is always a center position (because the plunger must, on energization, first be pulled up to admit ink into sleeve 14), it is possible for the retaining force exerted by the device 4 to be lower than the force applied to the plunger by the coupler 5. The pulling-up in FIG. 1*b* is possible only against the frictional force acting between the members 48 and 149; since this is not as simple as in the other embodiments, the one in FIG. 1*b*—although capable of being utilized in the sense of the invention—is not considered to be as advantageous as the ones in the other Figures.

While the invention has been illustrated and described as embodied in a dot-printer plunger control arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

A machine able to work with a dot printer following this invention is described in my pending U.S. Pat. application Ser. No. 735,198 and my CH-PS 605137.

There is also shown a working beam carrying the dot printers.

I CLAIM:

1. In a dot printer, a combination comprising a plurality of adjacent printing plungers; means mounting said plungers for reciprocation in respective upright paths, including for each of said plungers an annular fixedly mounted member; means retaining each of said plungers in a neutral rest position, including for each of said plungers a sleeve mounted on one end of the respective plungers, extending slidably through a respective one of said annular members and having spaced ends provided with respective flanges, and springs reacting between opposite axial sides of said annular member and the respective flanges for retaining the plunger in said neutral position thereof; drive means performing an oscillating movement in direction lengthwise of said paths; and means for intermittently coupling selected ones of said plungers to, and for subsequently uncoupling them from said drive means.

2. In a dot printer, a combination comprising a plurailty of adjacent printing plungers; means mounting said plungers for reciprocation in respective upright paths, said mounting means including for each of said plungers a mounting member; means retaining each of said plungers in a neutral rest position, said retaining means comprising for each of said plungers an elastically deflectable element connected to the respective plunger and said mounting member, said elastically deflectable element being a flexible diaphragm having an outer periphery, and said mounting member being a clamping ring which clampingly engages said outer periphery; drive means performing an oscillating movement in direction lengthwise of said paths; and means for intermittently coupling selected ones of said plungers to, and for subsequently uncoupling them from said drive means.

3. A combination as defined in claim 2, wherein said elastically deflectable element comprises several elastomeric filaments.

4. In a dot printer, a combination comprising a plurality of adjacent printing plungers; means mounting said plungers for reciprocation in respective upright paths; means retaining each of said plungers in a neutral rest position, retaining means comprising an advanceable and retractable engaging element which is movable into and out of a retaining position in which it engages the respective plunger, an electromagnet and a spring, one of which tends to retain said engaging element in said position and the other of which tends to move said engaging element out of said position; drive means performing an oscillating movement in direction lengthwise of said paths; and means for intermittently coupling selected ones of said plungers to, and for subsequently uncoupling them from said drive means.

* * * * *